US007530938B2

(12) United States Patent
Long

(10) Patent No.: US 7,530,938 B2
(45) Date of Patent: May 12, 2009

(54) PNEUMATIC ROLLER FOR PASSING FILM WITH ATTACHMENTS THROUGH ROLLERS OF MACHINE

(75) Inventor: Jimmy Lee Long, Canton, GA (US)

(73) Assignee: Illinois Tool Works Inc., Glenview, IL (US)

( * ) Notice: Subject to any disclaimer, the term of this patent is extended or adjusted under 35 U.S.C. 154(b) by 502 days.

(21) Appl. No.: 10/612,481

(22) Filed: Jul. 1, 2003

(65) Prior Publication Data

US 2005/0003942 A1 Jan. 6, 2005

(51) Int. Cl.
*B30B 5/02* (2006.01)

(52) U.S. Cl. ..... 493/388; 492/4; 492/16; 492/30; 100/162 B

(58) Field of Classification Search ..... 493/388, 493/394, 393; 492/16, 28, 30, 4; 100/162 B
See application file for complete search history.

(56) References Cited

U.S. PATENT DOCUMENTS

| | | | | | |
|---|---|---|---|---|---|
| 2,647,014 | A | * | 7/1953 | Edwards | 239/559 |
| 2,952,889 | A | * | 9/1960 | Hanssen | 26/101 |
| 3,808,350 | A | * | 4/1974 | Kluge et al. | 174/15.7 |
| 4,334,640 | A | * | 6/1982 | van Overbruggen et al. | 222/207 |
| 4,551,134 | A | * | 11/1985 | Slavik et al. | 604/67 |
| 4,649,954 | A | * | 3/1987 | Dunwoody | 137/355.17 |
| 4,722,725 | A | * | 2/1988 | Sawyer et al. | 604/27 |
| 5,215,539 | A | * | 6/1993 | Schoolman | 604/541 |
| 5,275,208 | A | * | 1/1994 | Lawrence | 138/121 |
| RE35,345 | E | * | 10/1996 | Adami | 493/355 |
| 5,569,326 | A | * | 10/1996 | Ruhl | 118/205 |
| 5,573,629 | A | | 11/1996 | Rock et al. | 156/522 |
| 5,589,258 | A | * | 12/1996 | Maddern et al. | 442/382 |
| 5,706,731 | A | * | 1/1998 | Francille et al. | 101/375 |
| 5,813,960 | A | * | 9/1998 | Schnyder | 492/18 |
| 5,913,268 | A | | 6/1999 | Jackson et al. | 101/420 |
| 6,062,751 | A | * | 5/2000 | Baum | 400/621 |
| 6,212,984 | B1 | * | 4/2001 | Kane | 83/100 |
| 6,382,100 | B1 | * | 5/2002 | Satoh et al. | 101/212 |
| 6,505,555 | B2 | * | 1/2003 | Kanda | 101/217 |
| 6,710,505 | B1 | * | 3/2004 | Barani et al. | 310/261 |
| 6,726,616 | B2 | * | 4/2004 | Militzer et al. | 493/424 |

* cited by examiner

*Primary Examiner*—Christopher Harmon
(74) *Attorney, Agent, or Firm*—Ostrager Chong Flaherty & Broitman P.C.

(57) ABSTRACT

An assembly comprising: a tube made of resilient material, at least a portion of the tube forming a circumferential boundary of a chamber; first and second end cap assemblies supporting the tube at opposite ends thereof and forming respective end boundaries of the chamber, the chamber being filled with pressurized fluid; a hard roller that forms a nip with the tube; a fixed structure that supports the first and second end cap assemblies and the hard roller, the first and second end cap assemblies and the hard roller being respectively pivotably coupled to the fixed structure, and the fixed structure comprising a passageway that is in fluid communication with the chamber; and a slider-zipper-film assembly that is passed through the nip. The tube is deformed radially inward to allow passage of slider through the nip.

8 Claims, 5 Drawing Sheets

PNEUMATIC ROLLER FOR PASSING FILM WITH ATTACHMENTS THROUGH ROLLERS OF MACHINE

BACKGROUND OF THE INVENTION

This invention generally relates to machines for forming articles from a moving web of film that carries an attached or integrally formed object (or objects). In particular, the invention relates to machines for manufacturing reclosable bags from a moving web of film that carries one or more slider-zipper assemblies.

The invention can be utilized in conjunction with many different methods of and machines for making reclosable bags. In particular, the invention has application in automated production lines that incorporate a "bag machine", which makes reclosable bags without filling them with product, and automated production lines that incorporate any one of a variety of form-fill-seal (FFS) machines, which produce sealed reclosable bags filled with product. In particular, the invention has application in machines that form a package, fill it with product, and then seal the product inside the package using any one of the known FFS methods, such as HFFS (horizontal form-fill-seal), VFFS (vertical form-fill-seal) with the zipper applied in either the machine or transverse direction, or HFVFS (horizontal form/vertical fill-seal).

In either case (bag machines or FFS machines), the slider may need to pass between sets of rollers during the manufacturing operations. In some cases, flanged zipper strips with sliders thereon pass between rollers on their way to a zipper application station where one or both of the zipper flanges is (are) joined to a web of bag making film. Thereafter, the web of film, with attached zipper or slider-zipper assemblies, passes through other rollers on its way to or inside a bag machine or a form-fill-seal machine. In the case of flangeless zippers (also known as "string zippers"), typically the backs of a pair of interlocked flangeless zipper strips are attached to a folded web of bag making film. In a recent development, sliders are inserted on the string zipper. The string zipper-film assembly with sliders may then pass through rollers on its way toward a filling station or out of a bag machine.

Optionally, the zipper and the web of bag making film can be extruded together, in which case the web and zipper are an integral formation, rather than an assembly. However, the integral formation of the zipper and web does not preclude the insertion of sliders on the zipper, in which case, again, the entire assembly may need to pass between rollers at some stage during further manufacturing operations.

Typically, such machines that move a web of film incorporate drive or pinch rollers for tensioning and moving the film through the machine. The web may be advanced through the machine either continuously or in discrete advancements separated by dwell times (i.e., intermittently). Any attachments to the web of film necessarily move with the web and must be passed through the pinch rollers. However, sliders cannot feasibly be passed through the nip formed by two pinch rollers.

It is well known to use rollers having hard surfaces, meaning surfaces that are not resilient and that cannot conform to the shape of an attached object when a film carrying that object is passed through the nip of the rollers. It is also known to provide a peripheral annular groove in one or both rollers to allow the objects on the pinched moving web to pass through the rollers. The groove (or grooves) is (are) shaped and sized to provide clearance for the attached objects to pass through as the film is pulled through the nip of the rollers.

However, the variety of manufacturing methods and bag sizes limits the versatility of hard rollers with peripheral grooves. In each application, the grooves on the rollers must be aligned with the position of the slider on the moving web. For example, slider-zipper assemblies can be attached to a web of bag making film either transversely or aligned with the machine direction. Also, the slider-zipper assembly can be placed anywhere on the web, so that the slider could be near one edge or the other or anywhere between. To account for these differences, the grooved pinch rollers need to be specific to the particular style or size of slider bag being made. This requires a large inventory of grooved rollers, which increases capital costs. Also the need to install different rollers on an automated production line increases downtime, resulting in lost productivity.

There is a need for a roller design that would allow a slider or other object being carried on a web of film to pass through the same set of rollers regardless of the lateral position of the slider (or other object) on the web.

BRIEF DESCRIPTION OF THE INVENTION

The present invention is directed to methods and apparatus for passing object-film assemblies between two nip-forming rollers when the object is too large to pass through the nip. Instead of providing annular grooves in the rollers to allow the object to pass through, one of the two rollers is constructed so that it is capable of deforming radially inward to allow the object to pass through the roller setup. The object may, for example, be a slider inserted on a zipper that is joined to film for making reclosable bags.

One aspect of the invention is an assembly comprising: a tube made of resilient material, at least a portion of the tube forming a circumferential boundary of a chamber; first and second end cap assemblies supporting the tube at opposite ends thereof and forming respective end boundaries of the chamber, and a fixed structure that supports the first and second end cap assemblies, which are respectively pivotably coupled to the fixed structure. The fixed structure comprises a passageway that is in fluid communication with the chamber.

Another aspect of the invention is an assembly comprising: an air shaft comprising an inlet, a passageway and an outlet, the inlet being in fluid communication with the outlet via the passageway; a pneumatic roller rotatably mounted to the air shaft and configured to form an annular chamber surrounding a portion of the air shaft, the passageway of the air shaft being in fluid communication with the chamber via the outlet of the air shaft; and first and second collars fixedly mounted to the shaft at respective positions adjacent opposite ends of the pneumatic roller. The collars restrict axial movement of the pneumatic roller relative to the shaft without restricting rotational movement of the pneumatic roller about the shaft.

A further aspect of the invention is a method comprising the following steps: inserting a slider on a zipper; attaching the slider-zipper assembly to a web of film; passing the slider-zipper-film assembly between a pneumatic roller and a hard roller that form a nip, wherein the pneumatic roller deforms radially inward to allow passage of the slider therethrough; and forming the slider-zipper-film assembly into a bag comprising a receptacle having a mouth with the slider-zipper assembly installed therein.

Yet another aspect of the invention is a method comprising the following steps: inserting a slider on a zipper comprising a pair of flanged zipper strips; passing the slider-zipper assembly between a pneumatic roller and a hard roller that form a nip, wherein the pneumatic roller deforms radially inward to allow passage of the slider therethrough; and attaching the slider-zipper assembly to a web of film.

A further aspect of the invention is a method comprising the following steps: coupling an object to a web of film; and passing the coupled object and web between a pneumatic roller and a hard roller that form a nip, wherein the pneumatic roller deforms radially inward to allow passage of the object therethrough.

Another aspect of the invention is an assembly comprising: a tube made of resilient material, at least a portion of the tube forming an outer peripheral boundary of a chamber; first and second end cap assemblies supporting the tube at opposite ends thereof and forming respective end boundaries of the chamber, the chamber being filled with pressurized fluid; a hard roller that forms a nip with the tube; a fixed structure that supports the first and second end cap assemblies and the hard roller, the first and second end cap assemblies and the hard roller being respectively pivotably coupled to the fixed structure, the fixed structure comprising a passageway that is in fluid communication with the chamber; and a slider-zipper-film assembly that is passed between the hard roller and the tube. The tube is deformed radially inward to allow passage of the slider therethrough.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

The roller setup disclosed herein can be used to tension and pull film carrying slider-zipper assemblies oriented either in a longitudinal (i.e., machine) direction or in a transverse direction. In either case and regardless of the lateral position of the sliders, the pneumatic roller disclosed herein deforms to allow passage of the slider through the rollers. Examples of typical slider-zipper-film assemblies that can pass through the roller setup disclosed herein will be described with reference to FIGS. 1-4.

Figure 1:
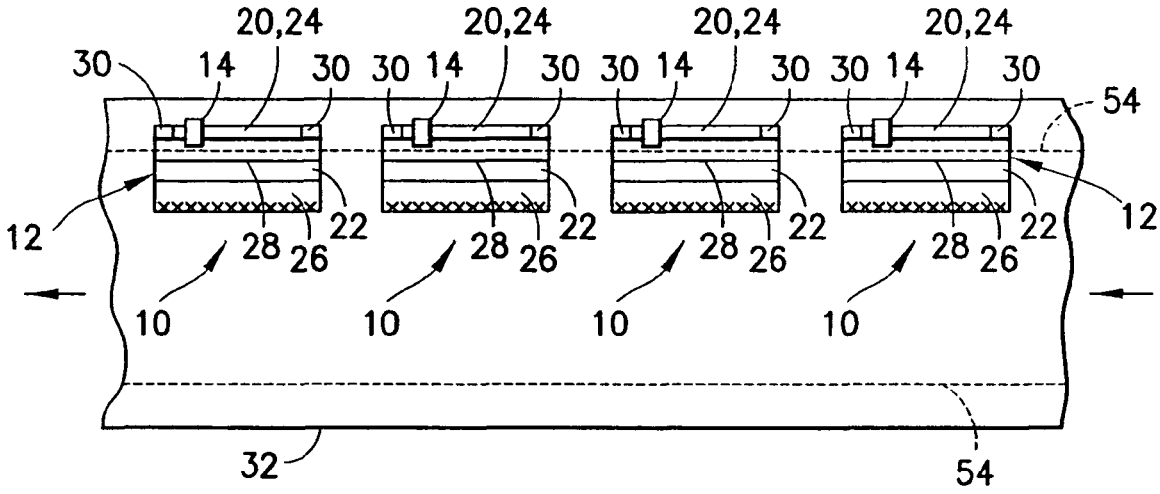
FIG. 1 PRIOR ART
FIG. 1 is a drawing showing a plan view of a plurality of slider-zipper assembly lengths attached in the machine direction to thermoplastic film in accordance with one known technique.

FIG. 1 shows a plurality of slider-zipper assemblies 10 of equal length joined to a web 32 of film and oriented in the machine direction. The dashed lines designated by the numeral 54 represent a pair of longitudinal lines of spaced perforations formed in the web 32 before the slider-zipper assemblies are applied. The assemblies 10 are spaced at equal intervals along the web 32. Each slider-zipper assembly 10 includes a reclosable zipper 12 and a straddling slider 14. The slider 14 is adapted to open the zipper 12 as it is moved therealong in an opening direction and to close the zipper 12 as it is moved therealong in a closing direction.

Figure 2:
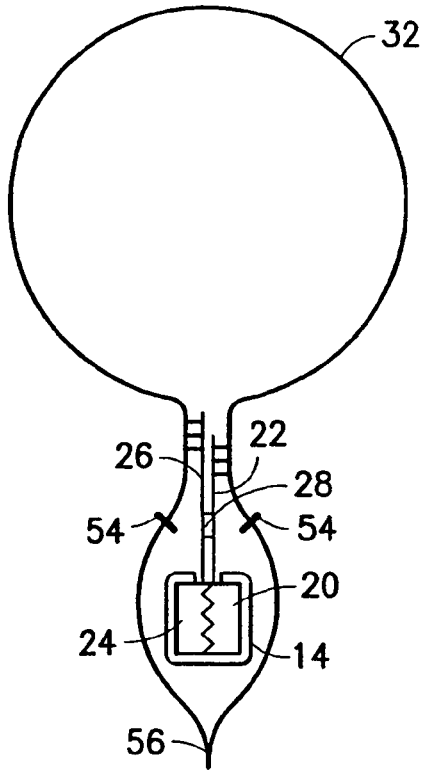
FIG. 2 PRIOR ART
FIG. 2 is a drawing showing a top view of a package being made on an FFS machine having a fill tube using the slider-zipper-film assembly of FIG. 1.

The zipper 12 includes a pair of profiled zipper strips. As seen in FIG. 2 (which shows the assembly of FIG. 1 after the film has been wrapped around a fill tube and sealed to itself at seal 56), one zipper strip comprises an interlocking member 20 and a flange 22 extending from the interlocking member 20 on one side thereof. Similarly, the other zipper strip comprises an interlocking member 24 and a flange 26 extending from the interlocking member 24 on one side thereof. As shown in FIG. 2, the zipper flanges 22, 26 extend in the same direction. The second zipper flange 26 is longer than the first 22 and is attached thereto by means of a peel seal 28. The interlocking members 20, 24 are interlockable with each other and are designed to cooperate with the slider 14 so that they may be readily engaged and disengaged as the slider 14 is moved along the zipper 12 in the closing and opening directions, respectively. The interlocking members 20, 24 may have any complementary shapes that permit their releasable engagement, including rib-and-groove profiles or sets of interlocking hooks.

Returning to FIG. 1, the interlocking members 20, 24 are sealed together, or stomped, at their ends. These seals 30 ensure that the interlocking members 20, 24 do not come apart at their ends and provide ends stops for the slider 14.

Preferably, the zipper flanges 22, 26 are coextruded with their corresponding interlocking members 20, 24, but may be extruded separately and attached later, such as by welding or by an adhesive. The zipper 12 and slider 14 are each made of a resilient plastic.

In the case of the longitudinal zipper method illustrated in FIG. 1, the pre-cut slider-zipper assembly lengths 10 are attached to the thermoplastic film 32 via the longer zipper flange 26. The longer flange 26 is attached to the film 32 by either a tack weld or a permanent weld. The weld is indicated by a series Xs along the edge of each zipper flange 26.

Preferably, the slider-zipper assembly lengths 10 are prepared on a known machine (not shown), located upstream of a known FFS machine (not shown), that cuts the zipper lengths 10 to size, stomps their ends and seals them to the thermoplastic film 32 as shown in FIG. 1. The machine may also be configured to apply the peel seal 28 between the zipper flanges, or the peel seal 28 may be pre-applied. The advantage of using a separate machine to prepare the slider-zipper lengths is that only minor changes, if any, need them to be made to the FFS machine. The sliders are preferably inserted onto the zipper before the zipper is cut and sealed to the film, but can be inserted afterward.

The slider-zipper-film assembly depicted in FIG. 1 is fed into an FFS machine (not shown), which forms the film into packages. The film is fed downwardly over a conventional forming collar (not shown) and around a conventional filling tube (not shown) of the FFS machine. The tube forms the circular shape of the film seen in FIG. 2. During the process, the lower edge of the web 32 is brought into confronting relationship with the upper edge of the web, and then the edges are joined at seal 56 by conventional conduction heat sealing, thus forming a conventional header that provides evidence of tampering with the package contents. Also, the lines 54 of perforations (i.e., tear lines) are brought into a generally opposing relationship. The header can be torn off by tearing the film along the tear lines 54. When a consumer initially desires to gain access to the contents of the package, the consumer simply tears off the tamper-evident seal 56 using the tear lines 54, moves the slider 14 to the opening end of the zipper, and pulls the package walls apart to open the peel seal 28.

Figure 3:
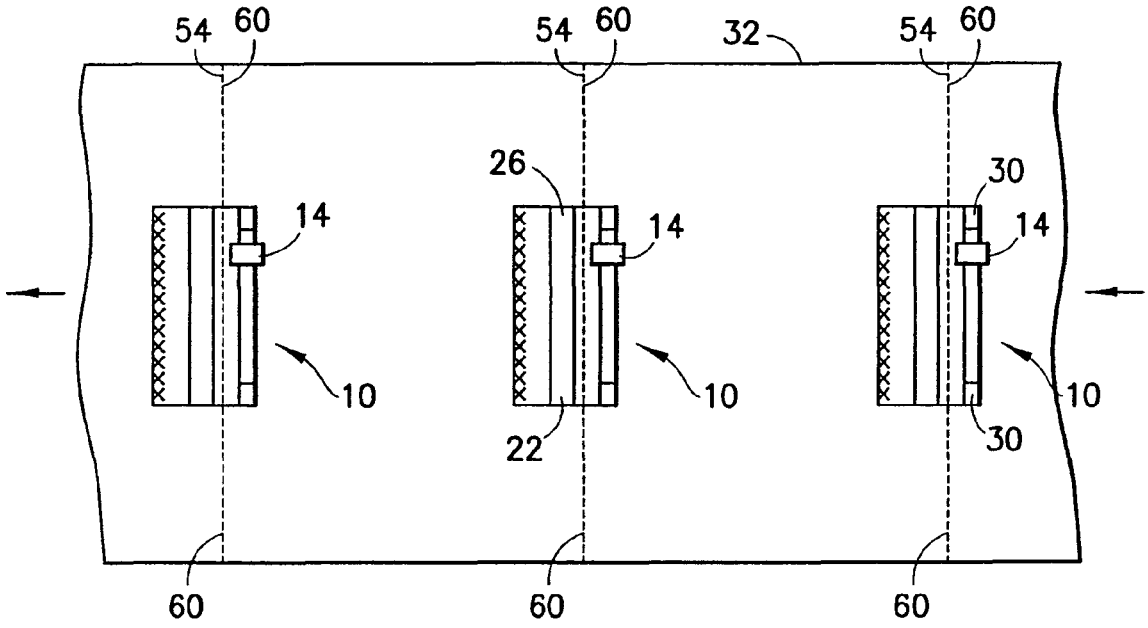
FIG.3 PRIOR ART
FIG. 3 is a drawing showing a plan view of a plurality of slider-zipper assembly lengths attached transversely to thermoplastic film in accordance with another known technique.
Figure 4:
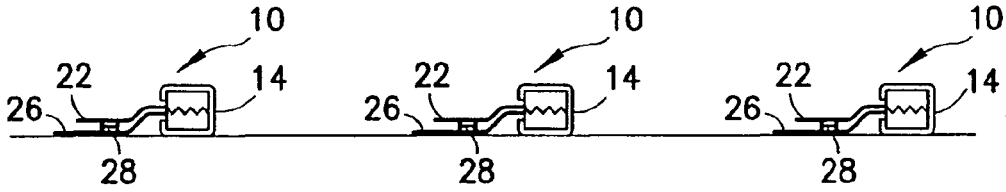
FIG.4 PRIOR ART
FIG. 4 is a drawing showing a side view of the slider-zipper-film assembly depicted in FIG. 3.

It is also possible to make reclosable packages on an FFS machine wherein the slider-zipper assembly lengths 10 are positioned transverse to the running direction of the thermoplastic film 32. FIG. 3 shows a portion of thermoplastic film 32 with lengths of slider-zipper assemblies 10 attached thereto. The slider-zipper assemblies 10 are oriented with their flanges extending in the running direction (indicated by the arrows) of the thermoplastic film. As shown in FIG. 4, which is a side view of the assembly depicted in FIG. 3, the longer flange 26 is positioned below the shorter flange 22 and sealed to the thermoplastic film as discussed above. The slider-zipper assemblies 10 are sealed to the thermoplastic film 32 at package length intervals.

Since the bag film 32 must overlap the zipper when the bag is formed, the thermoplastic film 32 is provided with a series of transverse lines 54 of perforations positioned at package length increments. Each line of perforations is positioned between the interlocking members 20, 24 and the portions of the flanges that will be sealed to the package walls in the FFS machine. Additionally, each line of perforations includes two (unperforated) gaps 60 corresponding to the location of the package side folds.

The slider-zipper-film assembly depicted in FIG. 3 may then be fed into a FFS machine (not shown) configured to make transverse zippered packages. Such structure and operations of such an FFS machine are well known and will not be described in detail herein.

Figure 5:
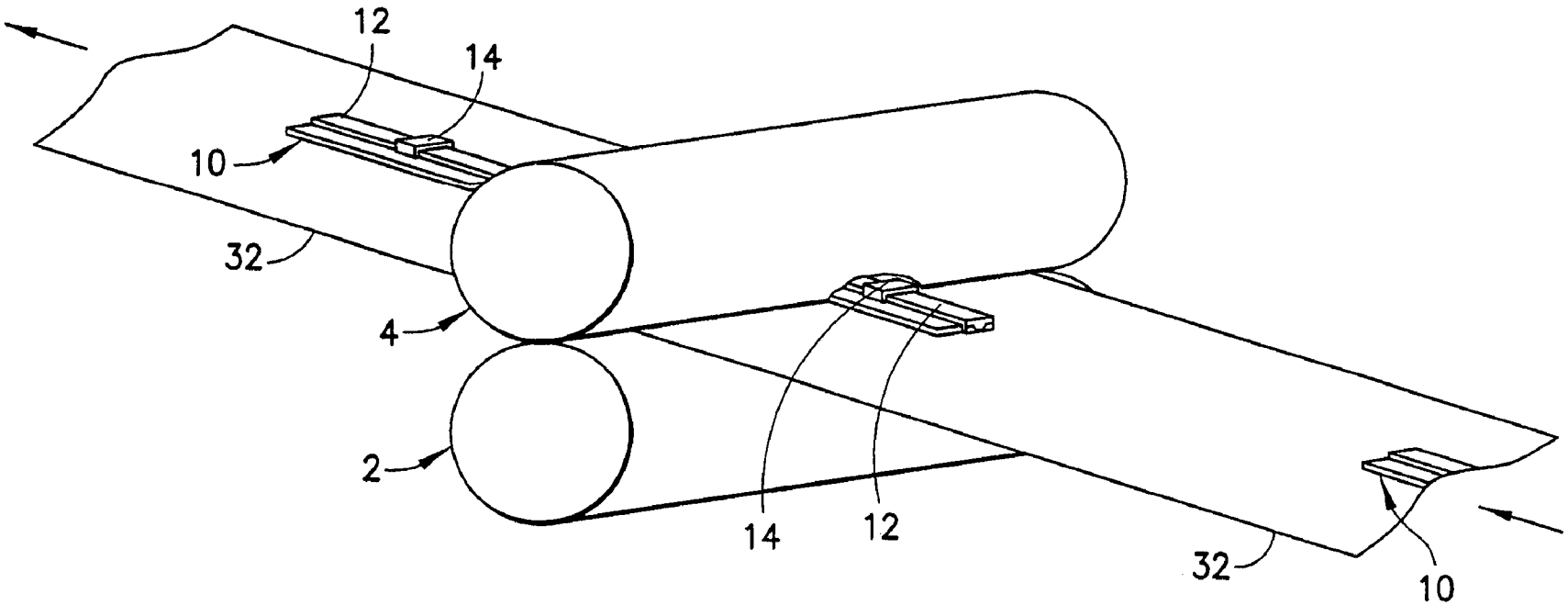
FIG. 5 is a drawing showing an isometric view of a roller setup in accordance with one embodiment of the invention.

The present invention can be utilized in conjunction with an FFS machine, a bag making machine or a zipper applicator. In any case, a roller setup comprising a hard roller and a soft roller can be employed for tensioning and pulling the web in the machine direction. One embodiment of the invention is generally depicted in FIG. 5, which shows a web 32 of film being pulled through a roller setup comprising a hard roller 2 and a pneumatic roller 4. The direction of web movement is indicated by arrows. In the example depicted, the web 32 carries a multiplicity of spaced slider-zipper assemblies 10 oriented in the machine direction. Obviously, the assemblies 10 could be oriented transversely instead. Each assembly 10 comprises a zipper 12 and a slider 14 mounted to the zipper 12. The roller 2 has a hard surface (e.g., steel), while the pneumatic roller 4 has a resilient surface (e.g., rubber) that deforms (as seen in FIG. 5) to allow each slider 14 to pass between the rollers as the web and zipper are pulled through the nip formed by the rollers. The resilient surface of the pneumatic roller 4 forms part of the boundary of a chamber that is filled with a pressurized fluid (gas or liquid), as described in detail below.

Figure 6:
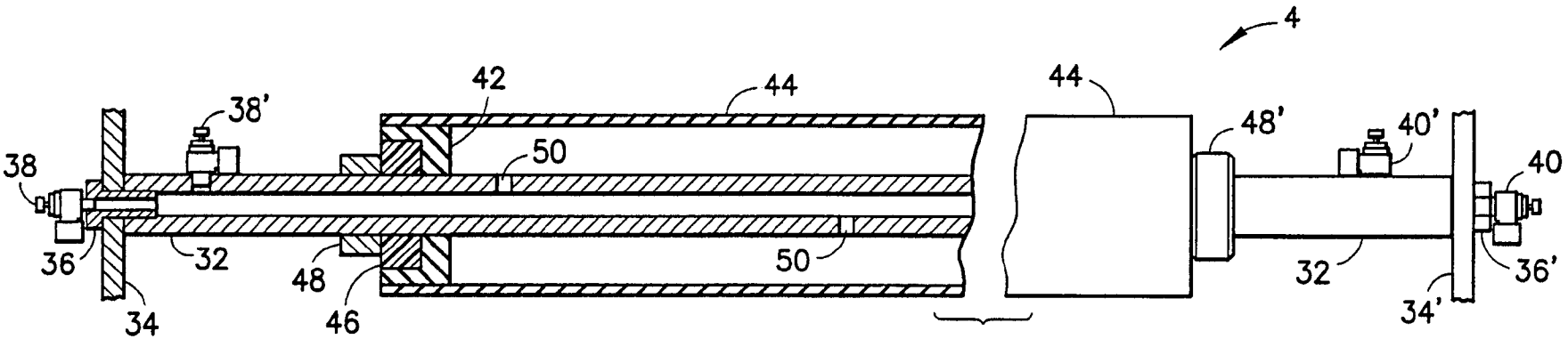
FIG. 6 is a drawing showing a partly sectional view of a pneumatic roller incorporated in the assembly depicted in FIG. 5.

The structure of a pneumatic roller assembly in accordance with one embodiment of the invention is presented in partial cross section in FIG. 6. The assembly comprises a shaft 32, which may, e.g., be made of aluminum or steel. The shaft 32 is tapped at both ends and centered drilled through to form a passageway. The passageway of shaft 32 receives pressurized fluid (e.g., air) via a pneumatic fitting 38, which is in fluid communication with an open tapped end of the shaft passageway via a modified hex head cap screw 36 that is hollow. The threaded shaft of the cap screw 36 is screwed into the first tapped end of the air shaft 32. The cap screw 36 is, in turn, supported by one member or plate 34 of a support frame. The other open tapped end of the air shaft 32 is in fluid communication with a relief valve fitting 40 via a cap screw 36' that is identical to cap screw 36. The threaded shaft of the cap screw 36' is screwed into the second tapped end of the air shaft 32. The cap screw 36' is, in turn, supported by another member or plate 34' of the support frame.

Instead of placing the fittings at the ends of the air shaft 32, the fittings may enter the air shaft radially. This alternative positioning of the fittings is indicated by the pneumatic fitting 38' seated in one radial orifice in the air shaft 32, and by the relief valve fitting 40' seated in another radial orifice in the air shaft 32.

As described above, both ends of the air shaft 32 are fixedly supported by a support frame, only portions of which are shown in FIG. 6. It should be understood, however, that members 34 and 34' would be fixed relative to each other, whether supported by the same frame or separate support frames. It should also be understood that the hard roller 2, depicted in FIG. 5, would be pivotably mounted to the same support frame or frames. The position of at least one of the rollers 2 and 4 shown in FIG. 5 is vertically adjustable to facilitate threading of the bag making film through the nip formed by the rollers.

In accordance with the embodiment depicted in FIG. 6, the pneumatic roller 4 is rotatable about the stationary air shaft 32. The pneumatic roller 4 comprises a generally circular cylindrical tube 44 made of an airtight resilient material such as a soft (airtight) closed-cell rubber. The material should be capable of grabbing various types of plastic films. The ends of the tube 44 are supported by and adhered to respective end cap assemblies. Each end cap assembly (only one of which is shown in structural detail in FIG. 6) comprises a cup-shaped end cap 42 having a central hole and a bearing 46 seated inside the end cap 42. The interfaces between the outer circumferential surfaces of the end caps and the inner circumferential surface of the tube are preferably airtight.

Each bearing 46 is rotatably mounted on the air shaft 32, while the associated end cap 48 is preferably insert-molded around the respective bearing. Each bearing 46 may comprise a conventional mechanical bearing (such as a ball bearing, a roller bearing, and so forth) or a ring made of durable thermoplastic material, such as ultra-high-molecular weight polyethylene. To reduce the amount of air that escapes between the end cap assemblies and the air shaft, each end cap assembly may optionally include one or more O-rings (not shown) that contact the outer circumferential surface of the air shaft. The O-rings may be greased to reduce air leakage.

The tube 44, air shaft 32 and end caps 42 define a generally annular chamber that is in fluid communication with the passageway of the air shaft by means of a multiplicity of radial orifices 50, only two of which are shown in FIG. 6. The annular chamber is filled with pressurized gas (e.g., aur0or liquid, the pressurized fluid being supplied via the pneumatic fitting 38, the passageway in the air shaft 32, and the orifices 50. The supply of pressurized fluid is precision regulated by means not shown. That pressurized fluid supports the tube 44 in its generally circular cylindrical shape, providing a cushioning effect that allows slider clips or other objects to pass through the rollers. The pressurized fluid thereafter pushes the soft rubber material of tube 44 back to its original designed form (e.g., a circular cylinder) after the slider clip or other object passes through.

The pressurized fluid also exerts oppositely directed pressure on the end caps 42, i.e., in opposite longitudinal directions. The end cap assembly closest to the pneumatic fitting 38 is blocked from sliding along the shaft 32 and toward the pneumatic fitting 38 by a set collar 48. Similarly, the end cap assembly (not shown in FIG. 6) closest to the relief valve fitting 40 is blocked from sliding along the shaft 32 and toward the relief valve fitting 40 by another set collar 48'. Thus, the collars 48 and 48' restrict the axial movement of the pneumatic roller 4 along shaft 32, but do not restrict the pneumatic roller's rotation about the air shaft.

The tube 44 should be designed so that in its natural (undeformed) state and at the design pressure inside the chamber, the outer circumferential surface of the tube does not deflect radially outward and thus remains equally balanced, meaning that the circumference of the tube is substantially unchanged along the length of the tube. This feature will allow the tube to track the film material properly. At the same time, the tube must be designed to allow the tube material to deform radially inward in response to the external pressure exerted by an object being pinched between the hard and soft rollers, as seen in FIG. 5. Tolerances would be implemented for both the inward and outward directions of deformation, which is the reason for precision regulation of the pressure of the fluid inside the chamber of the pneumatic roller.

Figure 7:
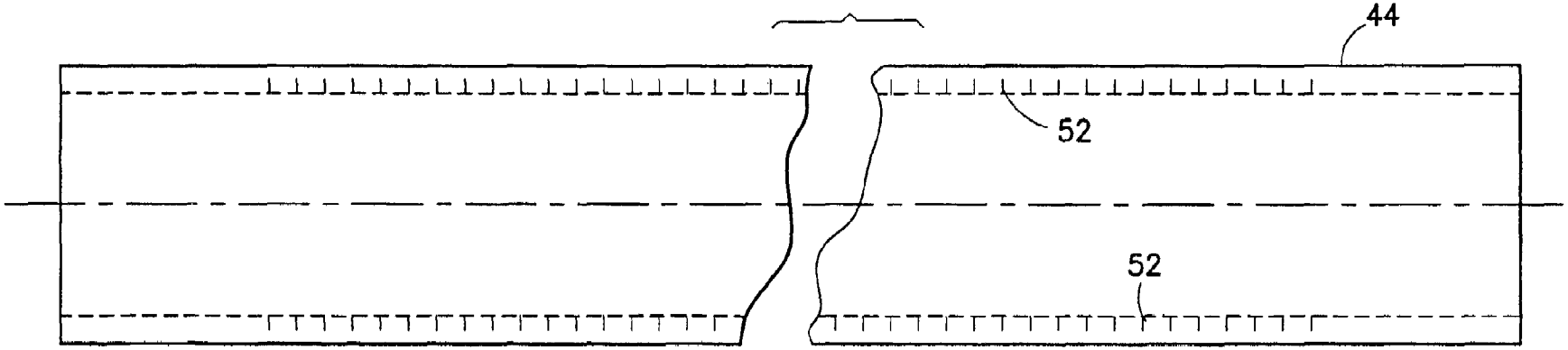
FIG. 7 is a drawing of a circular cylindrical tube incorporated in the pneumatic roller depicted in FIG. 6. The thickness of the tube is indicated by the dashed lines, while the series of short lines intersecting and orthogonal to the dashed lines represent a series of spaced relief cuts.

More specifically, the tube 44 is constructed so that it resists radially outward deformation more than it resists radially inward deformation. This susceptibility for radially inward deformation allows the tube to form a pocket (as depicted in FIG. 5) that allows a slider or other object to pass between the hard roller 2 and the pneumatic roller 4. At the same time, the film or other substrate that carries the slider or other object passes through the nip of the rollers. The reduced resistance of the tube material to radially inward deformation is achieved by providing a multiplicity of transverse annular cuts 52 on the inner periphery of the tube 44, as shown in FIG. 7. The cuts begin at the inner circumferential surface (indicated by a pair of mutually parallel dashed lines in FIG. 7) of the tube 44, but do not reach the outer circumferential surface of the tube. The cuts are spaced at equal intervals along the longitudinal axis of the tube. It is only necessary that the cuts 52 be formed in the area of the annular chamber, since cuts where the end caps reside would serve no purpose. Each of the annular transverse cuts has a depth that is constant in a circumferential direction, the depth being the same for each cut. If necessary, the spacing of the cuts may be varied in order to maintain a constant deformation of the tube at various locations along its length. As seen in FIG. 7, each pair of adjacent annular transverse cuts 52 bounds a respective annular ring section in the inner peripheral portion of the tube 44. Each of these annular ring sections is integrally formed with the uncut outer peripheral portion of the tube, the annular ring sections and the uncut outer peripheral portion being made of the resilient material.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

The invention claimed is:

1. An assembly comprising:

an air shaft comprising an inlet, a passageway and an outlet, said inlet being in fluid communication with said outlet via said passageway;

a pneumatic roller rotatably mounted to said air shaft and configured to form an annular chamber surrounding a portion of said air shaft, said passageway of said air shaft being in fluid communication with said chamber via said outlet of said air shaft; and first and second collars fixedly mounted to said shaft at respective positions adjacent opposite ends of said pneumatic roller; said first and second collars restricting axial movement of said pneumatic roller relative to said shaft without restricting rotational movement of said pneumatic roller about said shaft, wherein said pneumatic roller comprises:

a generally circular cylindrical tube made of resilient material, at least a portion of said tube forming an airtight outer peripheral boundary of said chamber; and first and second end cap assemblies rotatably mounted to said air shaft at opposite ends of said chamber, said first end cap assembly being fitted inside one end of said tube and said second end cap assembly being fitted inside the other end of said tube, wherein said tube comprises a multiplicity of annular transverse cuts extending from an inner peripheral surface of said tube toward, but not reaching, an outer peripheral surface of said tube.

2. The assembly as recited in claim 1, wherein each of said annular transverse cuts has a depth that is constant in a circumferential direction, said depth being the same for each of said annular transverse cuts.

3. The assembly as recited in claim 2, wherein said annular transverse cuts are axially spaced at equal intervals along said tube.

4. A roller setup comprising a hard roller and said assembly as recited in claim 1, said hard roller and said pneumatic roller forming a nip.

5. The assembly as recited in claim 1, wherein each of said first and second end cap assemblies comprises a respective end cap and a respective bearing fitted into said respective end cap, said end caps forming substantially airtight interfaces with said tube.

6. The assembly as recited in claim 5, wherein each of said end caps is made of hard rubber molded around said respective bearing.

7. The assembly as recited in claim 1, wherein said tube is made of soft closed-cell rubber.

8. The assembly as recited in claim 1, wherein said tube resists radially outward deformation more than it resists radially inward deformation.

* * * * *